United States Patent [19]

Sinden

[11] Patent Number: 4,936,236

[45] Date of Patent: Jun. 26, 1990

[54] SYMMETRICAL SAILBOAT WITH MOMENT BALANCING RIG

[76] Inventor: Frank W. Sinden, 739 Prospect Ave., Princeton, N.J. 08540

[21] Appl. No.: 325,646

[22] Filed: Mar. 20, 1989

[51] Int. Cl.[5] ..... B63H 9/04

[52] U.S. Cl. ..... 114/39.1; 114/89; 114/103

[58] Field of Search ..... 114/39.1, 39.2, 89, 114/90, 91, 93, 98, 102, 103, 124, 108, 111

[56] References Cited

U.S. PATENT DOCUMENTS

| | | | |
|---|---|---|---|
| 1,885,247 | 11/1932 | Fox | 114/103 |
| 2,756,711 | 7/1956 | Simpson | 114/39 |
| 3,094,961 | 6/1963 | Smith | 114/102 |
| 3,173,395 | 3/1965 | Laurent | 114/39 |
| 3,223,065 | 12/1965 | Wilson, Jr. | 114/39 |
| 3,295,487 | 1/1967 | Smith | 114/39 |
| 3,304,899 | 2/1967 | Weatherly | 114/39 |
| 3,336,890 | 8/1967 | Laurent | 114/39 |
| 3,931,779 | 1/1976 | Kreuger | 114/39.1 |
| 3,985,090 | 10/1976 | Rineman | 114/39 |
| 4,044,702 | 8/1977 | Jamieson | 114/102 |
| 4,273,060 | 6/1981 | Pavincic | 114/39 |
| 4,539,926 | 9/1985 | Boffer | 114/39 |
| 4,541,355 | 9/1985 | Denton | 114/98 |
| 4,788,924 | 12/1988 | Hamel | 114/90 |
| 4,809,629 | 3/1989 | Martinmaas | 114/102 |

*Primary Examiner*—Joseph F. Peters, Jr.
*Assistant Examiner*—Ed Swinehart
*Attorney, Agent, or Firm*—Mathews, Woodbridge & Collins

[57] ABSTRACT

A fully symmetrical sailboat includes a mechanism that balances the moment of a sailor on a boom against the force of the wind on the sail in such a way that the hull remains level. The sailboat comprises a hull with both lateral and longitudinal symmetry and a rig consisting of a short, rotatable mast to which is attached by hinges a sail of symmetrical plan and a boom bearing a slidable seat. The rig as a whole can assume any angular position about a vertical axis. Under pressure of the wind, the foot of the sail can swing outward. The sail is mechanically linked to the seat boom so that its outward motion lifts the seat boom's outer end. The linkage is such that over a wide range of wind forces and regardless of the sailor's position along the boom, the rig as a whole exerts substantially no net moment on the hull. Foot operable rails are used to adjust the angle of the rig about the vertical axis, hence the angle of the sail to the wind. Steering is controlled by hand held reins connected to a symmetrical, linked pair of hydrofoils, which serve as both rudders and centerboards. The sailboat's combination of symmetry, balance and convenient controls provides an increased degree of maneuverability coupled with high speed.

13 Claims, 7 Drawing Sheets

SYMMETRICAL SAILBOAT WITH MOMENT BALANCING RIG

BACKGROUND OF THE INVENTION

1. Field of the Invention

This invention relates to a light sailboat having full lateral and fore-aft symmetry and, more particularly, to one using a swingable seat boom to balance the sail force moment.

2. Description of the Prior Art

The lateral equilibrium of a sailboat is largely determined by a balance between two force couples, i.e. between two pairs of equal and opposite, but offset, forces. The first of these force couples comprises the components in the lateral plane of the wind force on the sail and the water force on the centerboard. The second couple comprises the upward lift on the hull (typically a combination of buoyancy and dynamic forces) and the downward force of gravity acting on boat and crew. The sailboat is in lateral equilibrium when the moments exerted by these two force couples are equal in magnitude and opposite in sense.

Designers of light sailboats strive to enlarge the offset distance between lift and gravity as much as possible so that for a given weight a large sail can be used. One way to do this is to provide a wide hull so that heeling will shift the lift force far to the lee side. Another similar way is to provide two (or even three) widely spaced narrow hulls. Boats with such hulls, however, sacrifice maneuverability for speed. In particular, they come about (i.e. make upwind turns) slowly and uncertainly because their small inertia is quickly absorbed by their resistance to turning. The proa, a type of multihull boat with fore-aft but not lateral symmetry, overcomes this problem by turning in a different way (called shunting) that does not depend on inertia.

Although proa-like boats can make upwind turns by shunting, they must sometimes execute a cumbersome maneuver to make a downwind turn. They can turn directly away from a downwind course in only one direction. To turn the other way, they must first turn away from the desired direction, then shunt. Conventional sailboats with lateral symmetry must also execute a special maneuver (called jibing) on one of the two downwind turns. This maneuver, while not slow, is somewhat awkward and can even be dangerous if not executed skillfully. For very fast sailboats downwind turns are important because such boats find it advantageous to tack downwind.

A solution to the downwind turning problem for a sailboat having the symmetry of the proa is offered by Pavincic (U.S. Pat. No. 4,273,060). That solution, however, depends on the use of a circular hull, which has much greater drag for a given displacement than an elongated hull. The boat set forth in the present disclosure permits direct downwind turns in either direction without shunting or jibing and without compromising the low drag of the hull.

The symmetry of the design disclosed in this specification, however, poses special problems not encountered in other designs. One of these is that the sail must be supported in such a way that it can assume any angle about the vertical axis. Conventional support structures tend to severely limit either the sail's size or the angle through which it can turn. A tripod support that apparently would allow complete rotation of a sail is disclosed by Jamieson in U.S. Pat. No. 4,044,702. That structure, however, appears to put a relatively large mass aloft and to generate a relatively large parasitic drag. It also requires a very wide base and is, therefore, unsuitable for the single hull boat disclosed herein.

Other less relevant patents that disclose sailboats having the symmetry of the proa include U.S. Pat. Nos. 2,756,711 (Simpson); 3,094,961 (Smith); 3,173,395 (Laurent); 3,223,065 (Wilson); 3,295,487 (Smith); 3,304,899 (Weatherly); 3,336,890 (Laurent); and 3,985,090 (Rineman).

An alternative to wide or multiple hulls to achieve a large lever arm between lift and gravity is provided by devices such as hiking straps and seat booms for shifting the crew weight outboard. The invention disclosed herein uses a seat boom. Different kinds of prior art seat booms are discussed, for example, in U.S. Pat. Nos. 1,885,247 (Fox) and 4,539,926 (Boffer). Another feature of the invention disclosed herein is a horizontally pivoted sail mount that allows the foot of the sail to swing outward and upward under wind pressure A relevant sail is disclosed in the cited patent of Fox (U.S. Pat. No. 1,885,247). This patent, however, does not suggest a nonlinear mechanical connection between a sail and a seat boom that constitutes the balancing mechanism set forth in the present disclosure.

SUMMARY OF THE INVENTION

Basically described, the invention comprises a fully symmetric sailboat with a self-balancing rig. By virtue of these features, the boat can maintain a level hull on all courses (this enhances speed and stability) and execute all turns in a quick and positive manner.

The main object of the invention is the achievement of a practical sailboat having a hull with fourfold symmetry (i.e. both fore-aft and lateral symmetry) and a rotatable rig with bilateral symmetry that can assume any angular position about the vertical axis. These symmetries allow the boat to avoid the inconvenient maneuvers mentioned above in connection with the prior art. They also pose certain problems for the designer, which are addressed by the features of the invention discussed below.

In the preferred embodiment, the hull is shallow and flat to facilitate planing. The rig consists of a short, rotatable mast to which are attached by hinges with horizontal axes a sail of symmetrical plan and a boom bearing a slidable seat. The boom extends horizontally outward from the mast in the rig's plane of symmetry. Two vertical hydrofoils depend from the underside of the hull near its ends. These are mechanically linked so that they rotate symmetrically in opposite senses about vertical axes in response to the sailor's control. They serve as both rudders and centerboards.

A first significant feature of the invention is a mechanism that automatically keeps the moments of the sail force and of the sailor's weight in balance so that the rig as a whole exerts no net moment on the hull. This balance serves two useful functions: First, it eliminates the need for stays, which would severely limit the size and motion of the sail. Thus, by permitting full rotation of the rig, it solves one of the problems posed by symmetry. Second, it keeps the hull level on all courses. This improves the hull's performance in a number of ways, in particular by facilitating planing, a condition in which dynamic lift greatly enhances speed.

A second significant feature of the invention is a system of sail-setting controls operable by the sailor's feet from any position. This feature solves another problem inherent in full symmetry.

A third significant feature of the invention, relating to rudder control, solves yet another problem posed by the symmetries of hull and rig. Since the rig must turn freely through any angle about the vertical axis, rudder control movements must be transmitted from the rig to the hull in a way that is independent of the rig's angular position. In addition, the linkage from the rudder to the control must not transmit the unstable forces that necessarily act on rudders that run both ways through the water. Finally, the rudder control must be readily accessible to the sailor whatever his position. The disclosed rudder control linkage satisfies these conditions.

Although the controls are simple and positive, there is considerable room for skill in exploiting the boat's full potential to maneuver, especially in racing. The challenge of developing such skill constitutes an advantage of the design.

The foregoing invention will be more fully understood with respect to the following drawings which form a part of this disclosure.

DETAILED DESCRIPTION OF THE PREFERRED EMBODIMENT

During the course of this description like numbers will be used to indicate like elements according to the different views of the invention.

Figure 1:
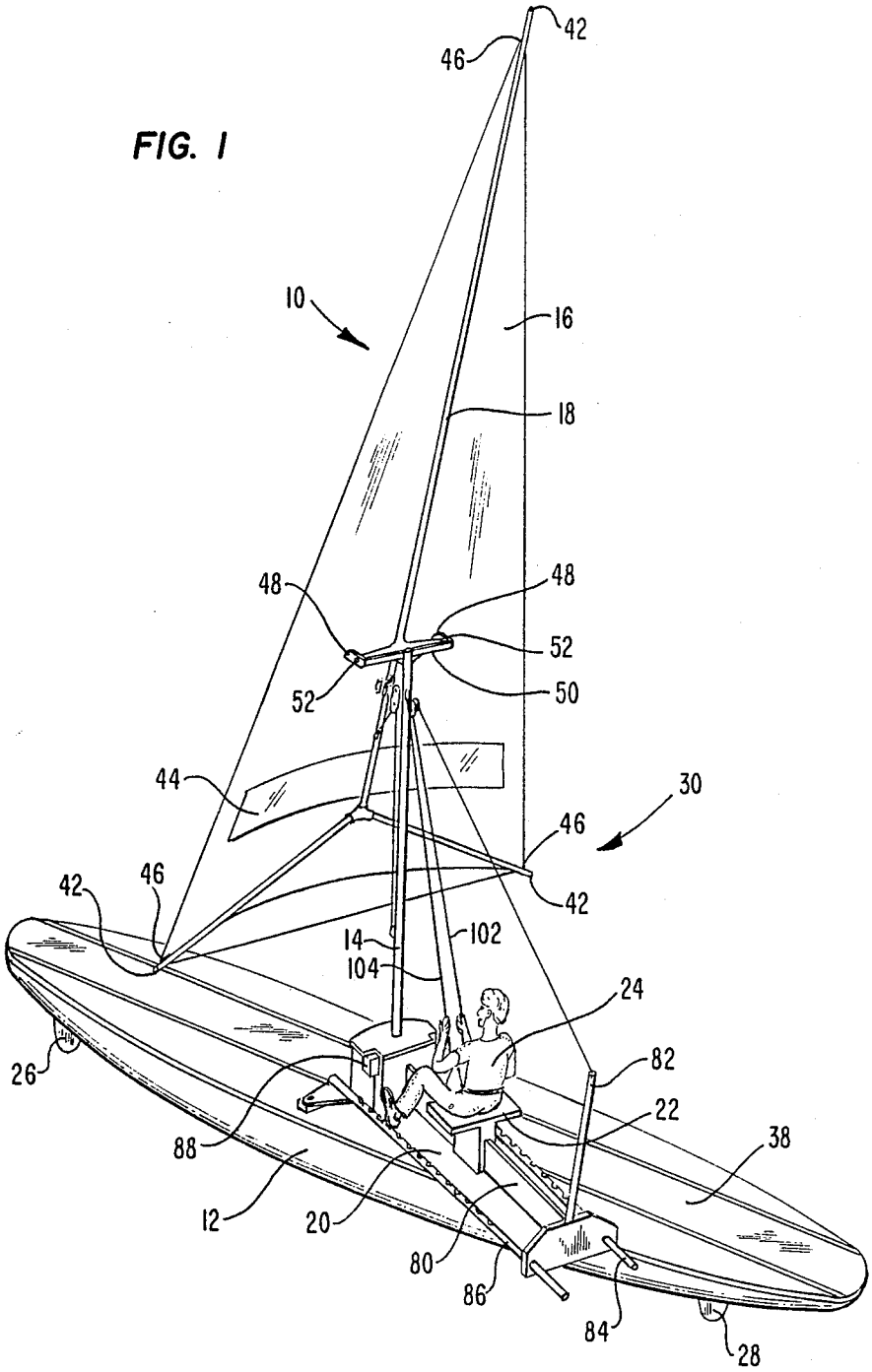
FIG. 1 is a perspective view of the entire sailboat invention according to the preferred embodiment thereof.

The general arrangement of the elements of the invention 10 can best be seen in FIG. 1. The hull 12, which is longitudinally as well as laterally symmetrical, may, in the course of normal maneuvering, travel either way through the water with the wind from either side. Because the invention 10 has both fore-aft and lateral symmetry it has no fixed bow or stern or port or starboard and, therefore, the forward portion of the boat can be at either end of the hull. Accordingly, those conventional elements are not identified as such in this disclosure. In the preferred embodiment, the hull 12 has an upper surface 38 and a flat bottom 40 sloped slightly upward from the center towards the ends to facilitate planing. Two vertical hydrofoils 26 and 28 depend from the hull near the two ends. These, serving both as rudders and as centerboards, are linked so as to turn in opposite senses (i.e. opposite rotational directions) about vertical axes.

The invention 10 described here employs a triangular sail 16 that is symmetrical with respect to a plane perpendicular to the sail's own plane. The sail 16 is supported by a frame 18, preferably having the form of an inverted Y, so that the wind strikes the sail 16 from the frame 18 side. The sail 16 includes a transparent window 44 therein so that the sailor 24 can look through the sail 16 to see where he is sailing. Frame 18 has three attachment portions 42 that attach to the three corners 46 of sail 16 respectively. A hinge 52 near the center of the sail frame attaches the sail frame 18 to the top of a short mast 14 in such a way as to allow the sail to swing about a horizontal axis. Hinge 52 is connected to a crosspiece 48 on the sail frame 18 and to a bracket 50 on the top of rotatable mast 14.

Figure 4A:
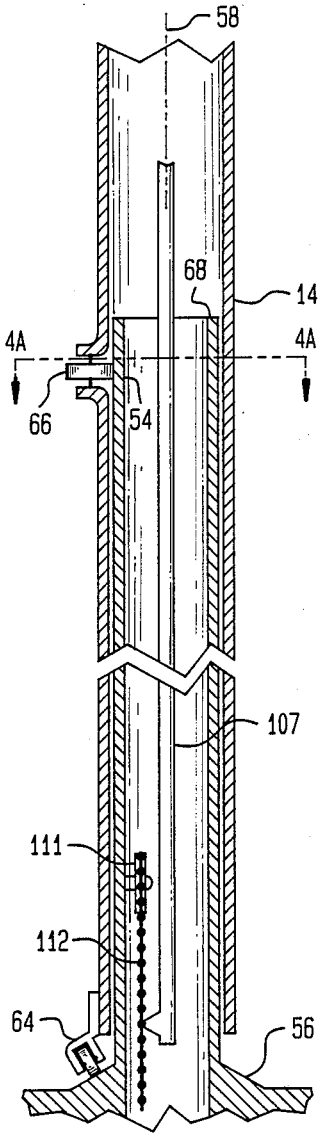
FIGS. 4A and 4B show vertical and horizontal cross sections respectively through the fixed and rotatable masts and illustrate the bearings that support the rig structure.
Figure 4B:
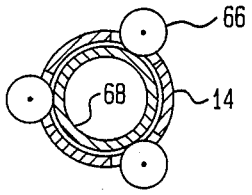

As shown in FIGS. 4A and 4B, the mast 14 is mounted in telescoping fashion over a fixed stub mast 68 so that it can rotate about the vertical axis 58 through the center of the hull. The fixed mast 68 has a top portion 54 and a base 56. In the preferred embodiment, rotatable mast 14 is supported by bearings at the top and bottom of fixed mast 68 consisting in each case of three equally spaced rollers 66 at the top and 64 at the bottom respectively. The bottom rollers 64 run on a conical surface 56 so that they can support both sideward and downward loads.

Attached to the rotatable mast 14, but on the side opposite from the sail 16, is a seat boom 20, lying along a line radial to the mast. See FIG. 1. The sailor's seat 22 is slidably mounted on a rail 80 on boom 20 so that the sailor 24 can move in and out. The sail frame 18, mast 14 and seat boom 20 constitute a single rig structure 30 that can assume any angular position about the vertical axis 58. Because of the balancing mechanism described below, this structure transmits no appreciable tilting moment to the hull 12. It therefore need not be braced with stays. The freedom from stays leaves the size and movement of the sail 16 unconstrained.

Figure 5A:
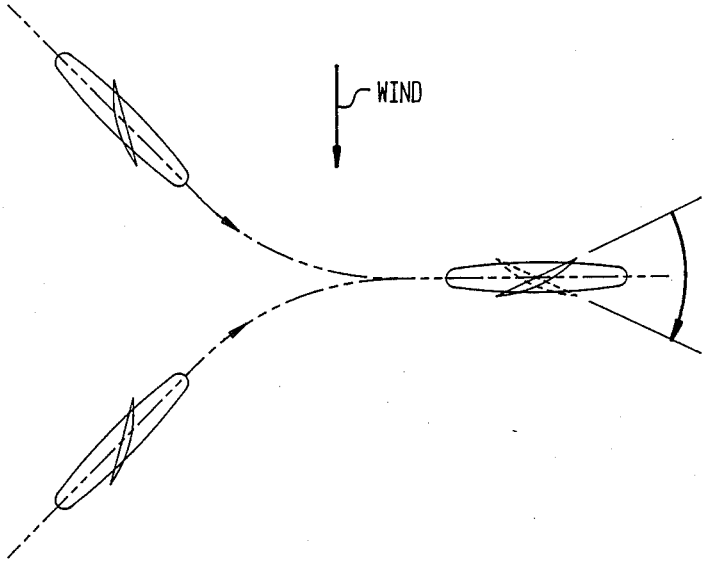
FIGS. 5A and 5B show respectively how upwind and downwind turns are executed.

With a hull 12 and rig 30 having the symmetry of shape and movement described above, the main maneuvers can be executed as follows:

Upwind turns: Upwind turns are made in the proa fashion by "shunting." In this maneuver the boat 10 changes direction so that bow and stern exchange roles. See FIG. 5A. To make the turn, the sailor 24 brings the hull 12 broadside to the wind as shown in FIG. 5A. More or less simultaneously, he swings the rig around the vertical axis 58 so that the driving component of the sail force 15 is opposite to the boat's motion. The boat 10 stops, then reverses. As it starts to move again, the sailor 24 turns it into its new (diagonally upwind) course. Note that shunting has the advantage that it is driven by the wind (rather than by inertia) so that the boat cannot get "caught in irons."

Downwind turns: Proa-like sailboats, i.e. those with longitudinal but not lateral symmetry, can turn directly away from a downwind course in only one direction. To turn the other way, they must first turn away from the desired direction, then shunt. Conventional sailboats (with lateral but not longitudinal symmetry) must also execute a special maneuver (called jibing) on one of the two downwind turns. On a downwind course, the mainsail of a conventional sailboat projects to one side. To turn toward this side, the sailor must first swing the sail to the opposite side. In a strong wind this can be tricky, and even dangerous, because the wind can catch the sail suddenly and sweep the boom across the deck with great force and speed. Although jibing can be done safely by experienced sailors, it is always a somewhat awkward maneuver that many prefer to avoid.

Figure 5B:
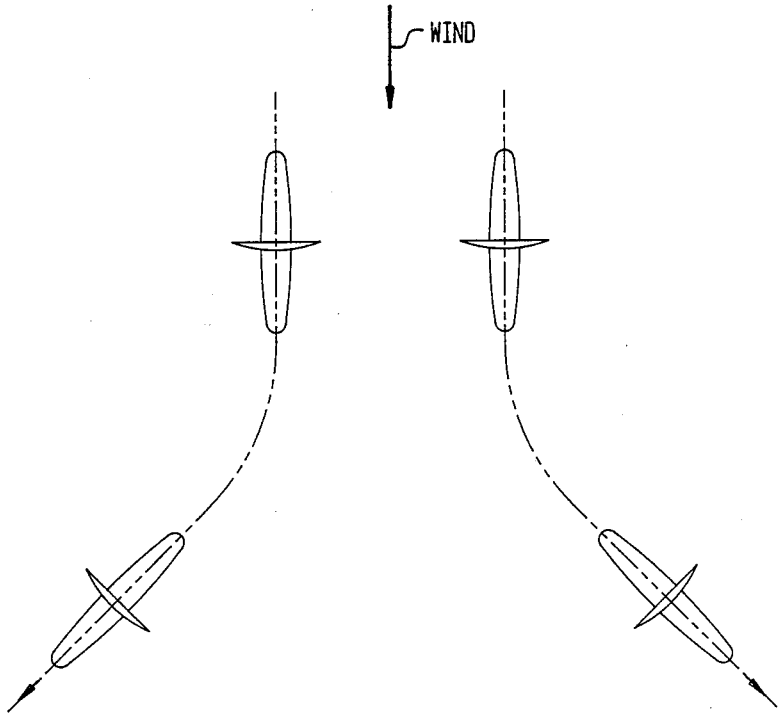

Because of its full symmetry, the sailboat disclosed here can turn directly away from a downwind course in either direction as shown in FIG. 5B. As noted above, downwind turns are especially significant for sailboats that are fast enough to benefit from downwind tacking.

Figure 2C:
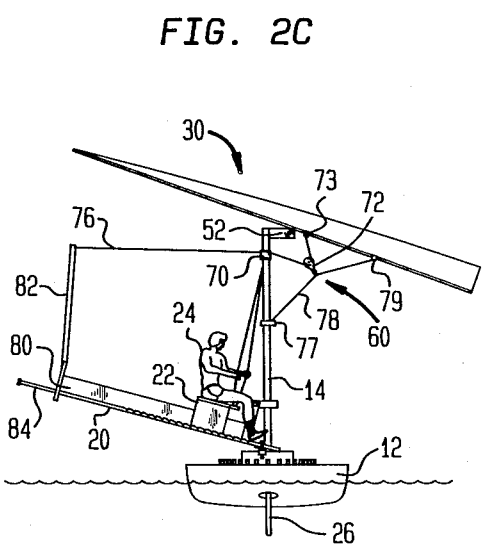
FIGS. 2A, 2B and 2C show the hull from the end and the rig from the side illustrating the balancing mechanism in three different positions.
Figure 2B:
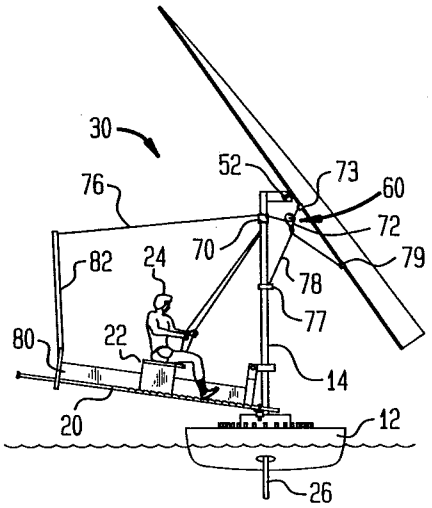
Figure 2A:
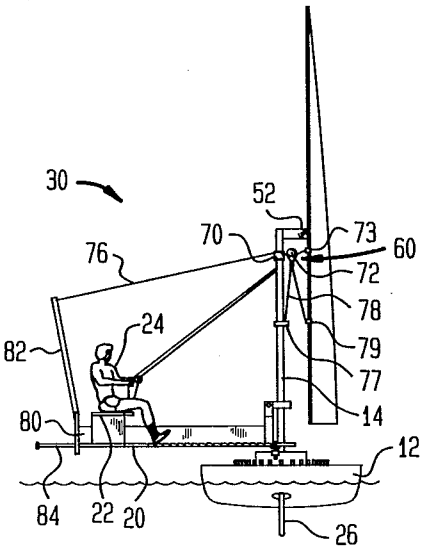

Both the sail frame 18 and the seat boom 20 are joined to the rotatable mast 14 by hinges with horizontal axes, the sail frame 18 by hinge 52, the seat boom by hinge 88. See FIG. 1. In addition, sail frame 18 and seat boom 20 are connected by a mechanical linkage 60 that lifts the outer end of the seat boom 20 upward when the foot of the sail 16 swings outward. See FIGS. 2A, 2B, and 2C. The mechanical advantage of linkage 60 varies with the sail's swingout angle in such a way that for any position of the sailor 24 along the seat boom 20, and for any wind velocity within a wide range, the sail-seat boom system comes to a stable equilibrium in such a position that the net tilting moment it exerts on the hull 12 is substantially zero. FIGS. 2A, 2B, 2C show how the sail angle changes with the sailor's position for fixed wind velocity.

Figure 2D:
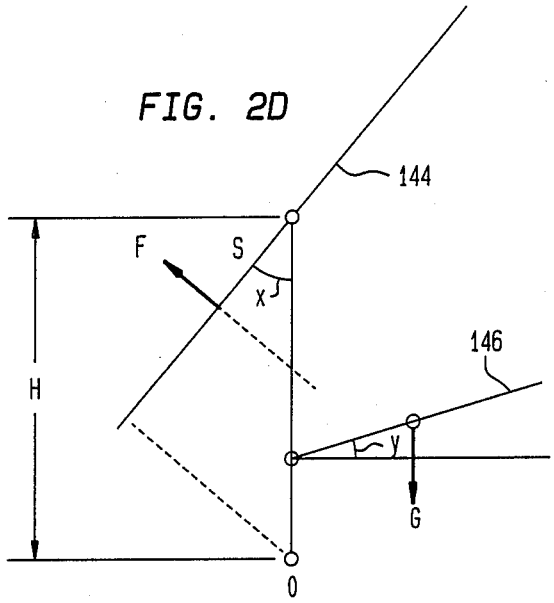
FIGS. 2D, 2E and 2F are graphs that explain the balancing mechanism.

The required variation in the mechanical advantage of linkage 60 is expressed by the formula given below. The symbols used in the formula are illustrated in FIG. 2D, in which lines 144 and 146 represent respectively the sail 16 and the seat boom 20. The symbols have the following meanings:

x=angle of sail 16 from vertical axis 58 y=angle of seat boom 20 from horizontal

F=total wind force on sail 16. F is substantially orthogonal to the sail's plane and acts on the sail's center of effort.

S=distance from sail's center of effort to sail's pivot 52.

G=weight of sailor 24 and seat boom 20.

0=level of the center of pressure on hydrofoils 26 and 28.

H=height of sail pivot 52 above 0.

The required variation in mechanical advantage can be expressed as a relationship between the incremental displacements of the sail and seat boom angles. Analysis shows this relationship to be $$dy/dx=1/[(H/S)\cos x-1].$$

Figure 2E:
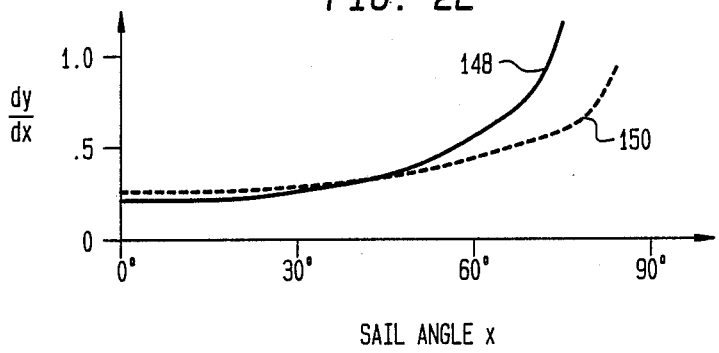

The solid curve 148 in FIG. 2E is a plot of this formula for $H/S=5.5$. If desired, the expression above can be integrated in closed form to give explicitly the relationship y(x) between the sail and seat boom angles. The approximation discussed below, however, applies most directly to the differential form.

Any linkage that reproduces the function y(x) determined by the formula given above will be in equilibrium when and only when the sail 16 and seat boom 20 are in the position that balances the moments of F and G about 0. Straightforward analysis demonstrates the stability of the equilibrium.

The function y(x) can be realized in various ways. For example, the linkage can be comprised of ropes running from the seat boom 20 and sail frame 18 to two suitably shaped spiral reels mounted on a common shaft. While a linkage of this kind can reproduce the required variable mechanical advantage exactly, the spiral reels it requires are cumbersome and expensive to fabricate.

A simpler linkage 60, requiring nothing more than two pulleys 70 and 72 can approximate the required functional form well enough provided certain distances are correctly chosen. This mechanism is shown in operation in FIGS. 2A, 2B and 2C. An approximately vertical spar 82 is rigidly attached to the end of the seat boom 20. From the top of spar 82 a first rope or line 76 runs over pulleys 70 and 72 to attachment point 73 on the sail frame 18. A second line 78 runs from attachment point 77 on the mast to attachment point 79 on the sail frame. At an intermediate point, line 78 is fastened to the frame or block of second pulley 72.

The relationship between the sail angle and the seat boom angle provided by linkage 60 depends on the positions of attachment points 73, 77, 79, and of pulleys 70, 72, as well as on the lengths of the lines 76, 78 and the length of spar 82. When these parameters are suitably chosen, the relationship realized by linkage 60 approximates the exact function given by the formula above. Dashed curve 150 in FIG. 2E shows such an approximation to the exact curve 148.

Figure 2F:
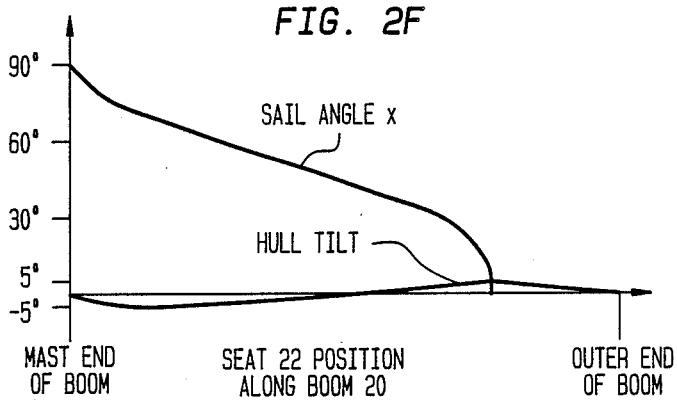

The approximation error causes the hull 12 to deviate slightly from the desired level position. Using a preferred set of parameter values consistent with curve 150, the hull tilt due to approximation error is estimated for the case of a strong wind close to the maximum design limit. FIG. 2F plots the estimated hull tilt as a function of the sailor's position along the seat boom 20. Also shown is the sail swingout angle x. The plot shows the hull tilt to be less than 5 degrees in all positions. In lighter winds the tilt is less. Note that the large approximation error shown in FIG. 2E for values of x above 60° is insignificant in causing hull tilt, because moments about 0 are small in that range anyway.

The forward driving component of the sail force is maximal when the sail 16 is vertical. As the sail 16 swings out, the driving component (as well as the lateral component) fall off as the cosine of the swing-out angle, while the lifting component increases as the sine of the swing-out angle. In a strong wind, the lifting component, by diminishing hull drag, partially compensates for the loss of driving force with increasing swingout. Consequently, the speed of the boat 10 tends to be nearly independent of swing-out angle over the range of 0 to 35 degrees or so. In normal operation the sailor 24 adjusts his position along the seat boom 20 so that the sail angle is near the middle of this range.

Figure 3:
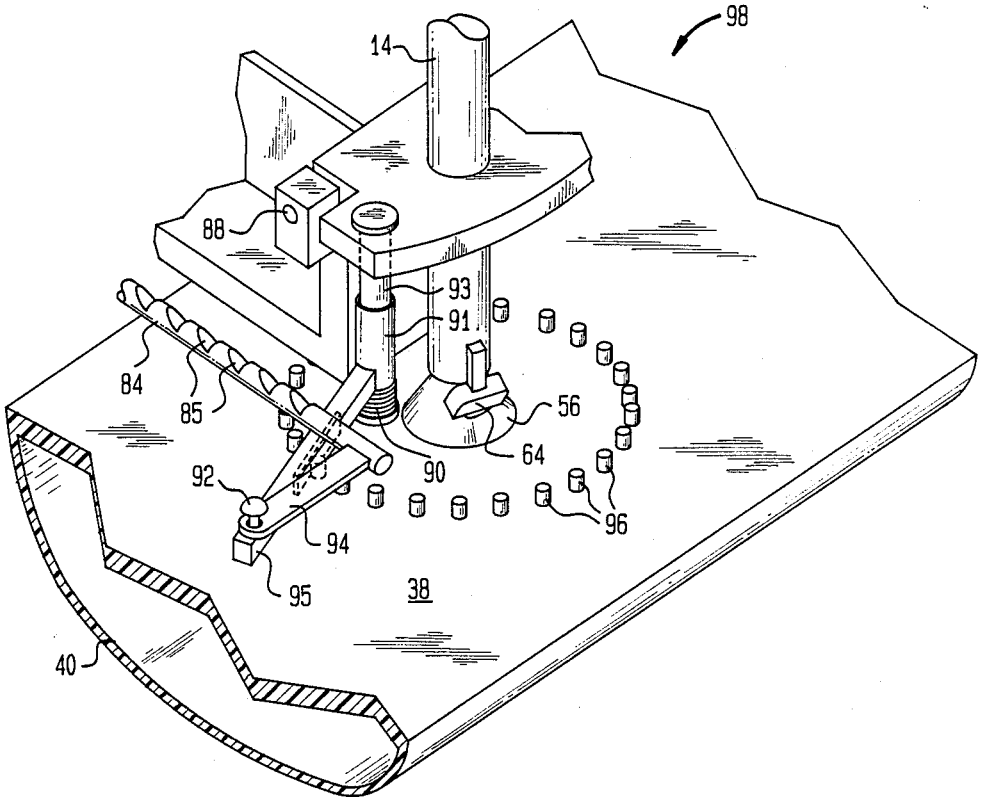
FIG. 3 is a detail of the foot operated mechanism for setting the angular position of the rig about the vertical axis.

The wind's angle of attack against the sail 16, i.e. the position of the sail 16 about the vertical axis, is set by means of a mechanism 98 shown in FIG. 3 which is operable by foot from any position of the sailor's seat 22. Two rails 84 and 86, shown in FIGS. 1 and 3, slidably mounted on the seat boom 20 and parallel to its axis, can be moved longitudinally by the sailor's feet. Periodic notches or cleats 85 along the rails 84 and 86 provide purchase. At the inner end, near the base of mast 14, rail 84 is fastened rigidly to arm 94, which is connected by pivot pin 92 to lever 95, which in turn can engage teeth or studs 96 arranged in a horizontal ring surrounding the mast 14. Lever 95 is attached rigidly to sleeve 91, which can rotate and slide vertically on shaft 93, which is attached rigidly to the rig structure. Spring 90 tends to lift lever 95 so that it disengages from studs 96. Downward foot pressure on rail 84 pushes lever 95 down so that it engages studs 96. Spring 90, in addition to lifting lever 95, also exerts a clockwise torque on lever 95, which, through pivot 92 tends to drive rail 84 outward. Downward and forward foot pressure on rail 84 acting through pivot pin 92 and lever 95 against one of the studs 96 imparts through shaft 93 and arm 94 a clockwise torque on the rig structure relative to the hull 12. A similar mechanism connected to rail 86 allows the sailor 24 to exert an opposite torque on the rig structure by downward and forward pressure on rail 86. By repeated foot motions, the sailor can step the rig structure around to any desired position about the vertical axis and thus set the sail 16 to any angle to the wind. Pivot pin 92 is made somewhat loose to accommodate the angular motion of the seat boom 20 about hinge or pivot 88.

On most courses, the wind exerts a moment about the vertical axis. This moment can be resisted by foot pressure on the appropriate rail 84 or 86, or, alternatively, it can be resisted by allowing the other rail 84 or 86, while engaged, to run against its forward limit. Holding the rail 84 or 86 in this locked position requires only enough pressure to resist the spring 90. In a strong wind, therefore, it is less tiring than resisting the wind pressure directly.

Figure 4C:
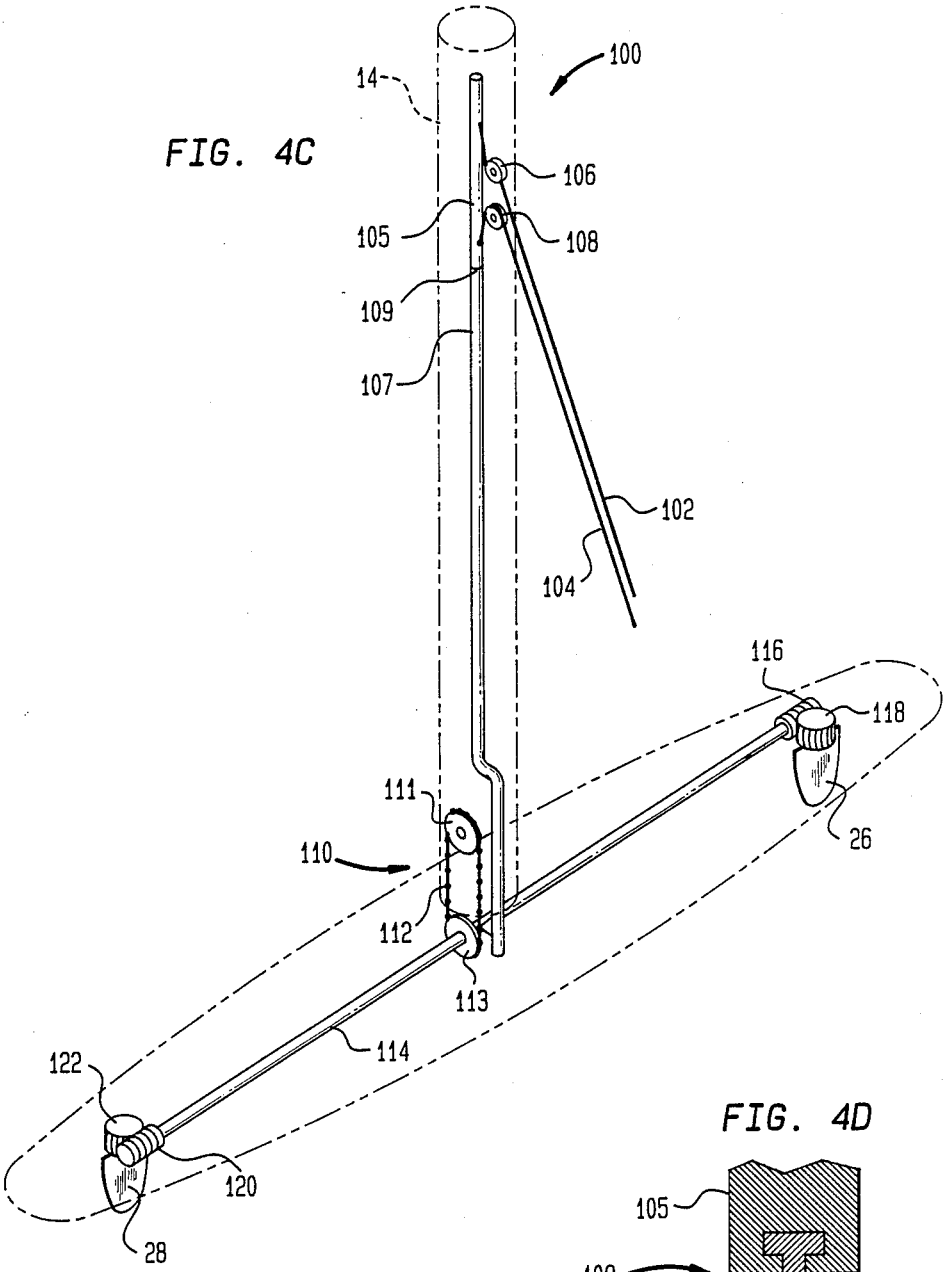
FIGS. 4C and 4D show the details of the steering linkage.

The rudders 26 and 28 are controlled by two ropes or reins 102 and 104 shown in FIGS. 1 and 4C which run from a point on the rotatable mast 14 diagonally downward to the sailor's seat 22. The sailor 24 preferably holds the rein that turns the boat 10 to the right in his right hand and the rein that turns it to the left in his left hand. To maintain this rule, however, he must switch hands whenever the boat 10 shunts. To keep track of the reins, a simple color code can be provided. In the preferred embodiment, red and green stripes running down the two sides of the deck distinguish the two sides in a readily visible way. The two reins are correspondingly colored: The red rein always turns the boat toward the red side.

The details of the rudder control linkage 100 are shown in FIG. 4C. Pulleys 106 and 108 are mounted in an opening in mast 14. Rein 102 passes under pulley 106 to an attachment point high on upper rod 105; rein 104 passes over pullery 108 to an attachment point low on upper rod 105. A pull on rein 102 drives the rod downward; a pull on rein 104 drives it upward. Upper rod 105 is slidably supported and keyed inside rotatable mast 14 in such a way that it can move vertically but cannot turn with respect to mast 14.

Figure 4D:
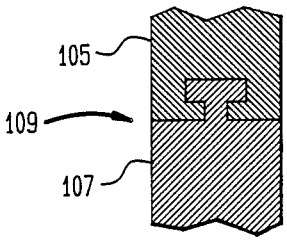

Upper rod 105 is connected to lower rod 107 by a rotary coupling 109 that transmits vertical motion but not rotary motion. This accommodates arbitrary rotation of the rig 30 with respect to the hull 12. A cross-section through the joint is shown in FIG. 4D. Lower rod 107 is slidably supported by and keyed to the inside of the fixed stub mast 60 shown in FIG. 4A. in such a way that it can move vertically but cannot turn with respect to fixed mast 68. The vertical motion of rod 107 is translated by a transmission mechanism 110 into rotary motion of shaft 114. This translation can be accomplished in a number of well known ways, e.g. by rack and pinion. In the preferred embodiment, however, the shallowness of the hull would greatly restrict the travel of a rack. Therefore, a different method is shown in FIGS. 4A and 4C. A chain 112, passing over idler sprocket 111 mounted inside fixed mast 68, drives sprocket 113 on shaft 114. The lower end of rod 107 is connected to chain 112 at a point between idler 111 and drive sprocket 113. The vertical motion of rod 107 thus turns shaft 114. Worm gears 116 and 120 at the ends of shaft 114 engage pinions 122 and 118 in such a way that rotation of shaft 114 turns hydrofoils or rudders 26 and 28 in opposite directions.

Alternatively, a simpler linkage from the reins 102 and 104 to the rudders 26 and 28 can be provided if the rotatable mast 14 is offset in the leeward direction from the central axis 58. Then the top of the fixed mast 68 can be exposed so that it is directly accessible to the sailor 24. The two reins 102 and 104 can pass through two separate fairleads in a cap surmounting fixed mast 68 and thence directly to a reel on shaft 114 about which they can be wrapped in opposite senses. Pulling on the two reins 102 and 104 then directly turns shaft 114 in opposite directions. This arrangement eliminates 105 and 107, the joint 109, and the chain 112 and sprockets 111 and 113. The arrangement is most convenient if the top of fixed mast 68 is about even with the seat 22. The shorter mast 68 is made, the greater are the loads on bearings 64 and 66. Because the rig exerts only small moments on the hull, these loads can be reasonably low even if mast 68 is short.

While the invention has been described with reference to the preferred embodiment thereof, it will be appreciated by those of ordinary skill in the art that various modifications can be made to the structure and function of the sailboat without department from the spirit and scope of the invention as a whole.

I claim:

1. A sailboat apparatus for sailing on water comprising:

a hull which is substantially symmetrical fore to aft and laterally, said hull having an upper surface and a lower surface;

a mast attached to said hull, said mast having a major long axis;

a sail attached to said mast, said sail having at least three corners;

a substantially rigid frame attached to said at least three corners of said sail;

pivot means attached to said frame and to said mast to permit said sail to rotate about an axis that is substantially perpendicular to the major axis of said mast;

a boom attached to said mast; and, balancing means attached to said boom, mast and sail for changing the angle of said boom with respect to said mast as the angle of said sail changes with respect to said mast, said balancing means including at least a pulley means, a first balancing line connecting said sail frame to said boom through said pulley means, and, a second balancing line connecting said sail frame to said mast and attached to said pulley means.

2. The apparatus of claim 1 further comprising:

setting means for setting said sail in different positions around said mast.

3. The apparatus of claim 2 wherein said setting means comprises:

foot operable rail means slidably attached to said boom for manipulation by the feet of a sailor;

resilient means attached to said rail means and to said mast for at least partially supporting one end of said rail means;

studs attached to the upper surface of said hull around the base of said mast; and, stud engagement means included in said rail means for selectively engaging at least one of said studs, wherein said rail means are manipulable by said feet of said sailor to selectively engage said studs thereby changing the set of said sail with respect to said hull.

4. The apparatus of claim 3 further comprising:
steering means for steering said apparatus.

5. The apparatus of claim 4 wherein said steering means includes:
at least a first and second rudder located respectively near opposite ends of the lower surface of said hull;
at least a first and a second rudder control line attached to said mast for controlling the rotation of said first and second rudders respectively; and,
a transmission mechanism located within said mast and within said hull for transmitting force applied to said first and second rudder control lines to said first and second rudders respectively to cause them to rotate in unison in opposite rotational directions.

6. The apparatus of claim 5 wherein said transmission mechanism further comprises:
a first and second rack attached respectively to said first and second rudders;
a first and second worm gear engageable with said first and second rack respectively and attached by a first rod to each other;
a second rod attached to said first and second rudder control lines and located inside said mast and attached to said first rod for causing said first rod to rotate in response to the upward and downward movement of said second rod; and,
coupling means attached to said first and second rods for causing said first rod to rotate in response to the upward and downward movement of said second rod.

7. The apparatus of claim 6 further comprising:
a seat attached to said boom for supporting a sailor.

8. The apparatus of claim 7 wherein said seat is slideable.

9. A sailboat apparatus for sailing on water comprising:
a hull which is substantially symmetrical fore to aft and laterally, said hull having an upper surface and a lower surface;
a mast attached to said hull, said mast having a major long axis;
a sail rotatably attached to said mast so that said sail can substantially fully rotate around said mast, said sail having at least three corners;
a substantially rigid frame attached to said at least three corners of said sail;
pivot means attached to said frame and to said mast to permit said sail to rotate about an axis that is substantially perpendicular to the major axis of said mast;
a boom attached to said mast on a side opposite said sail; and,
balancing means attached to said boom, mast and sail for changing the angle of said boom with respect to said mast as the angle of said sail changes with respect to said mast,
wherein the rotation of said sail around said mast permits said sailboat apparatus to shunt when sailing upwind.

10. The apparatus of claim 9 further comprising:
setting means for setting said sail in different positions around said mast.

11. A sailboat apparatus for sailing on water comprising:
a hull which is substantially symmetrical fore to aft and laterally, said hull having an upper surface and a lower surface;
a mast attached to said hull;
a sail rotatably attached to said mast so that said sail can substantially fully rotate about said mast;
a boom attached to said mast on a side opposite said sail;
a seat attached to said boom for supporting a sailor; and,
balancing means attached to boom, mast and sail for changing the angle of said boom with respect to said mast as the angle of said sail changes with respect to said mast.

12. The apparatus of claim 11 wherein said seat is slidable along said boom.

13. A sailboat apparatus for sailing on water comprising:
a hull which is substantially symmetrical fore to aft and laterally, said hull having an upper surface and a lower surface;
a mast attached to said hull, said mast having a major long axis;
a sail attached to said mast, said sail having at least three corners;
a substantially rigid frame attached to said at least three corners of said sail;
pivot means attached to said frame and to said mast to permit said sail to rotate about an axis that is substantially perpendicular to the major axis of said mast;
a boom attached to said mast on a side opposite from said sail; and,
linkage means connecting said boom to said sail frame for constraining the angle between said boom and said mast to a predetermined function of the angle between said sail frame and said mast, said predetermined function being such that the net heeling moment remains substantially zero with changes in wind force.

* * * * *